US005785146A

United States Patent [19]

Palmer

[11] Patent Number: 5,785,146

[45] Date of Patent: Jul. 28, 1998

[54] ARBOREAL CLIMBING AND SUPPORT METHOD AND APPARATUS

[75] Inventor: Kenneth Michael Palmer, Auburndale, Mass.

[73] Assignee: International Champion Techniques, Inc., Weston, Mass.

[21] Appl. No.: 443,626

[22] Filed: May 18, 1995

[51] Int. Cl.[6] ..... A47L 3/04

[52] U.S. Cl. ..... 182/3; 189/9; 189/133; 294/74

[58] Field of Search ..... 182/3, 9, 133; 294/74

[56] References Cited

U.S. PATENT DOCUMENTS

| | | | |
|---|---|---|---|
| 1,686,288 | 10/1928 | Meals | 294/74 |
| 2,561,487 | 7/1951 | Bailhe | 294/74 |
| 2,946,619 | 7/1960 | Wahl | 294/74 |
| 3,583,750 | 6/1971 | Norton | 294/74 |
| 3,592,502 | 7/1971 | Bolliger | 294/74 |
| 3,625,559 | 12/1971 | Lawrence | 294/74 |
| 3,992,048 | 11/1976 | Berzenye | 294/74 |
| 4,298,091 | 11/1981 | Anderson | 182/3 |
| 4,396,091 | 8/1983 | Anderson | 182/3 |
| 4,545,460 | 10/1985 | Byrd | 182/107 |
| 4,597,351 | 7/1986 | Brainard, II | 294/74 |
| 4,714,135 | 12/1987 | Bell et al. | 182/6 |
| 4,729,345 | 3/1988 | Anderson | 119/96 |

FOREIGN PATENT DOCUMENTS

| | | | |
|---|---|---|---|
| 2025109 | 3/1992 | Canada | 294/74 |
| 722958 | 7/1942 | Germany | 294/74 |
| 1037095 | 8/1958 | Germany | 294/74 |
| 780794 | 8/1957 | United Kingdom | 294/74 |
| 1409243 | 10/1975 | United Kingdom . | |
| 1528702 | 10/1978 | United Kingdom | 294/74 |
| 2066205 | 7/1981 | United Kingdom | 294/74 |
| 2237062 | 4/1991 | United Kingdom . | |

OTHER PUBLICATIONS

McMaster–Carr Supply Co., Catalog 93, pp. 528–531, 1987.

LiftAll, Catalog WSC–91, p. 6, 1989.

High–Tree–Tech, Katalog Herbst 1994, pp. 8 and 13, Sep., 1994.

1995 Sherrill, Inc., Catalog, insider cover facing page and p. 22, Mar., 1995.

High–Tree–Tech, Katalog Herbst 1994, p. 8, Sep. 1994.

*Primary Examiner*—Donald P. Walsh
*Assistant Examiner*—William A. Rivera
*Attorney, Agent, or Firm*—Choate, Hall & Stewart

[57] ABSTRACT

A climbing and support apparatus and method to facilitate performance of maintenance activity in a tree by an arborist. Briefly, the apparatus includes dual annular rings having dimensions in accordance with a predetermined geometric relationship disposed at proximal and distal ends of a nonuniformly compliant element, typically manufactured of high strength webbing. Serial passage of a rope with a modified portion through the rings and about a desired support location in accordance with a predetermined sequence permits ground level installation of the apparatus in a remote location in the tree. The apparatus is configured to prevent abrasion damage to both the tree and climbing rope and may be safely and reliably retrieved from ground level upon completion of desired maintenance activity in the tree.

22 Claims, 4 Drawing Sheets

ARBOREAL CLIMBING AND SUPPORT METHOD AND APPARATUS

TECHNICAL FIELD

The present invention relates generally to a method and apparatus for supporting a load from a support member and more specifically to a method and apparatus for supporting an arborist working in a tree.

BACKGROUND INFORMATION

Numerous tree climbing devices and methods of support are presently available to the arborist for use in facilitating care and maintenance of trees, especially in urban settings. Such devices range from large, costly systems employing buckets disposed at the end of hydraulic-powered, truck-mounted multiaxis articulated booms, to one or more climbing ropes used in combination with a climbing harness. Selection of the method and apparatus to be used in a particular application depends on a number of factors including height, location and accessibility of the tree, foliage and branch density proximate the regions of interest, as well as the nature and amount of work to be performed. For example, a boom truck may be desirable for use in the removal of a large number of branches from a curbside tree which threaten electrical power lines passing nearby; whereas, a rope and harness may be advantageously employed to trim deadwood from an exotic tree species located in a private garden which is otherwise inaccessible by boom truck.

Beyond relevant issues of cost and utility, care must be taken by the arborist to prevent harm to the tree on which work is being performed. If the arborist is required to climb the tree, the method and apparatus employed potentially adversely impact the health and integrity of the tree, to varying degrees. For example, even limited use of climbing spikes may cause serious distress to young trees having thin bark layers, creating pockets prime for initiation of parasitic insect or disease infestation. Tree crotches, the V-shaped junctions between two limbs or between a limb and the main stem or trunk of a tree, are routinely used to support a climbing rope. In one technique, a length of rope is disposed in the crotch and fixedly attached to a climbing harness at one end thereof. The free portion of the rope is attached to the harness with a friction knot, after being passed around the limb or stem. While such a scheme is advantageous in that the arborist may work efficiently in several areas by moving relatively freely about a limited region of the tree through adjustment of the rope loop length supported in the crotch, such movement routinely results in significant abrasion damage to the bark and often damages the underlying cambium layer of the tree responsible for secondary growth. Such techniques also accelerate climbing rope abrasion and wear, necessitating replacement of the costly rope. Additional pads of leather or other sacrificial material may be attached to the tree in an attempt to protect both the tree and rope; however, such devices are difficult to employ effectively, due to the tendency of the climbing rope to slip off the pad during use due to changes in orientation and attitude of the arborist relative to the support location. Such devices are also typically unwieldy and bulky, requiring proximate positioning of the arborist for proper manual installation and retrieval.

Protection of the tree from direct abrasion due to movement of the climbing rope may also be afforded through the use of lifting slings, similar in configuration to those typically employed in the movement of cargo by cranes or other lifting devices. For example, a continuous loop of rope or webbing may be employed in a conventional choker hitch configuration in a tree crotch or around a tree limb. A climbing rope may pass through the free end loop formed therein to support the arborist as discussed hereinabove. While generally reducing bark abrasion, such a configuration can damage the tree if the load being supported exceeds the capability of the limb, if the constriction of the limb becomes too great, or if the sling slips and moves while under load.

An additional problem with the use of a conventional loop sling in combination with a climbing rope is the not inconsequential problem of installation and removal of the sling in the tree. Conventional methods of ascending the tree, including the use of ladders, climbing spikes or solely ropes which abrade the bark, must often be employed to permit the arborist to reach a suitable location for installation of the sling. Generally, a relatively high altitude location is chosen to afford advantageous support for one or more of a plurality of targeted work regions. Once there, the arborist installs the sling on the limb and couples the climbing rope thereto, at which point the arborist may safely descend and begin work. Since the arborist may be some distance from the original support location after completing work in one region of the tree, a second sling may need to be employed to establish a second suitable support location for completing additional work in another region of the tree. In this manner, numerous slings may be required to adequately performed the desired maintenance on the tree. In addition to the weight and bulk of the slings which much be carried by the arborist, retrieval thereof is problematic, requiring either individually revisiting the support locations to manually remove the slings or attempting to remotely remove them, for example by pulling on separate ropes attached to the slings themselves. Remote retrieval may be frustrated by catching, snagging or wedging of the loop sling in a tree crotch or on a branch, ultimately necessitating revisiting that location to manually remove the sling. The additional retrieval ropes may also become entangled with the climbing rope, arboreal equipment or other portions of the tree. Further, uncontrolled remote retrieval poses a potential safety hazard both to the arborist and others working in the vicinity due to the free-falling sling, as well as to the tree which may be damaged if the sling becomes caught on inaccessible limbs, branches or foliage and must be forcibly removed.

SUMMARY OF THE INVENTION

A climbing and support apparatus particularly well-suited for use by arborists and others working in trees is disclosed, as are advantageous methods for remote installation and retrieval, as well as operational use thereof. The climbing and support apparatus comprises a compliant element suitable for conformance under load to a tree limb or other support member without harm thereto, and first and second closed annular members or rings captured at proximal and distal ends thereof, respectively. The annular members are predeterminedly sized to afford a mechanism for controlled remote installation and removal of the apparatus, wherein the internal diameter of the first ring has a value less than that of the internal diameter of the second ring, which in turn has a value less than that of the external diameter of the first ring. Accordingly, passage of the first ring through the second ring is prevented; however, a rope passing through both rings may be configured with a collar or interlacement proximate one end to afford free passage through the second ring while preventing passage through the first.

Remote installation is afforded by passing a rope serially through the first ring, over a support member in a first direction, through the second ring, and ultimately over the support member in an opposite direction relative to the first. Applying tension to the rope displaces solely the second ring and the distal end portion of the compliant element over the support member completing the installation. The rope may be used thereafter to support the arborist, arboreal equipment or other loads as required or desired.

Attachment of a collar to or formation of an interlacement in the rope to create an obstruction of predetermined outer diameter greater than the inner diameter of the first ring and less than the inner diameter of the second ring affords the capability of controlled remote removal of the apparatus from the support member. By releasing tension applied to the rope along the initial direction or by applying greater tension along a direction opposite thereto, the second ring is displaced from a position over the support member and the apparatus may be safely lowered to the ground in a controlled manner.

BRIEF DESCRIPTION OF DRAWINGS

The novel features believed characteristic of the invention are set forth and differentiated in the appended claims. The invention in accordance with preferred and exemplary embodiments, together with further advantages thereof, is more particularly described in the following detailed description taken in conjunction with the accompanying drawings in which:

MODE(S) FOR CARRYING OUT THE INVENTION

Figure 1:
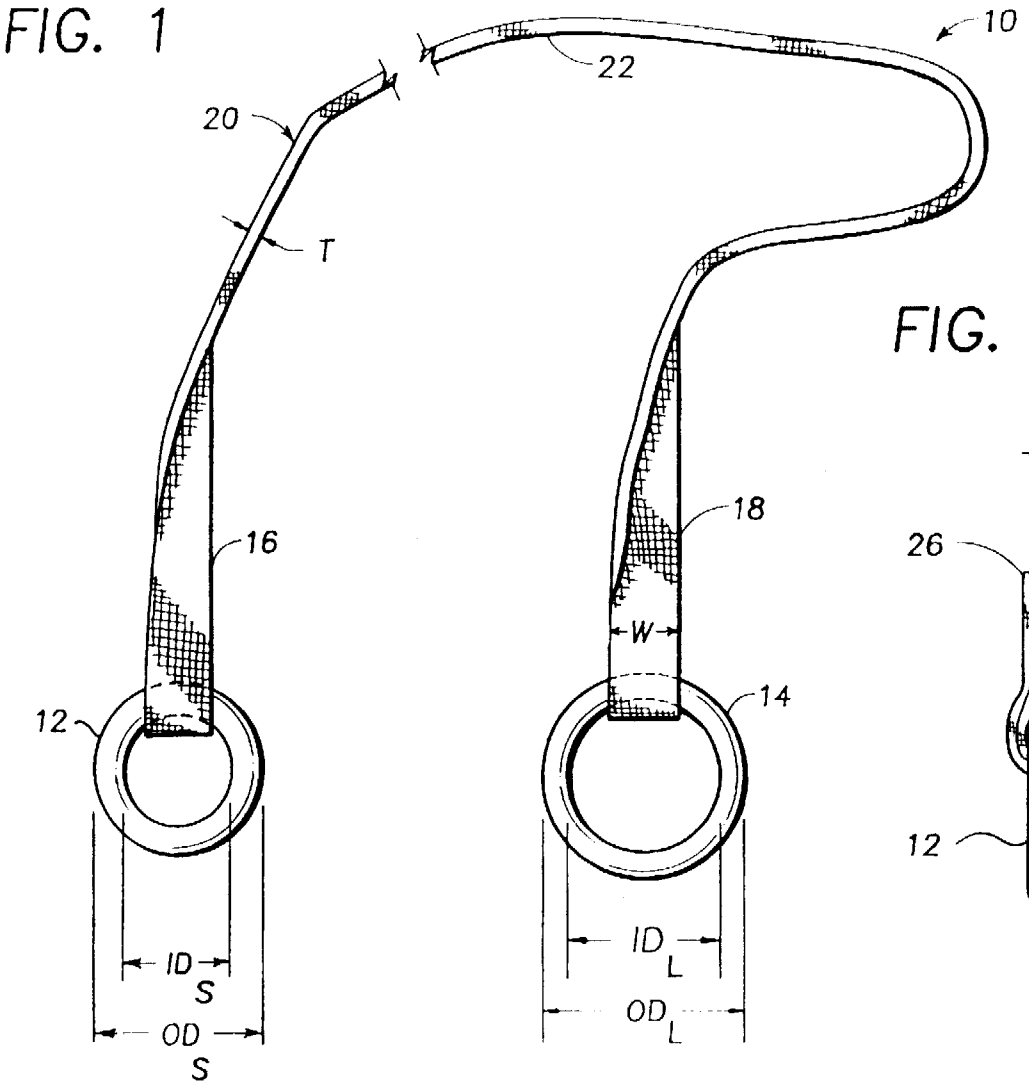
FIG. 1 is a schematic, plan view of the climbing and support apparatus in an uninstalled state, in accordance with a preferred embodiment of the present invention.

Depicted in FIG. 1 is a schematic, plan view of the climbing and support apparatus 10 in an uninstalled state, in accordance with a preferred embodiment of the present invention. The apparatus 10 includes a first closed annular member or small ring 12 and a second closed annular member or large ring 14 both being captured at respective first and second end portions 16, 18 of a substantially compliant element 20. In a preferred embodiment, the rings 12, 14 are manufactured from a high strength to weight ratio material such as aluminum and the compliant element is comprised of a single, continuous length of high strength synthetic tubular webbing which has been flattened and serially passed through the rings 12, 14, being stitched together to capture the rings 12, 14 in loops formed therein as will be discussed in greater detail hereinbelow. The embodiment of the apparatus 10 depicted here is adapted for simple, efficient manufacture; however, as will become apparent, the invention is neither limited to manufacture from these particular materials, nor is the invention limited to the particular configuration depicted in FIG. 1. For purposes of clarity of illustration, the compliant element 20 is shown twisted in two locations, proximate end portions 16, 18, such that a central portion 22 is viewed along an edge thereof. In general, a width W of compliant element 20 is substantially uniform along the entire length thereof; however, the thickness T may be advantageously varied along discrete portions by modifying the number of ply layers of webbing to afford beneficial nonuniform compliancy, the desirability of which will be discussed further hereinbelow.

Additionally, while respective sizes of the rings 12, 14 and overall length of the compliant element 20 may be adapted to suit a particular application or range of applications, relative sizes of the rings 12, 14, one to another, are preferably controlled to facilitate practice of the method of remote installation and retrieval of the apparatus. The desirability of selecting particular combinations of ring and webbing geometries will become apparent as additional details of the construction and advantageous manner of use of the apparatus 10 are disclosed.

Figure 2A:
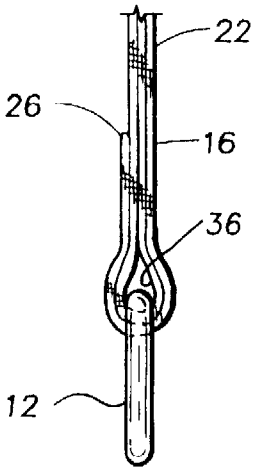
FIG. 2A is a schematic, side view of a first end portion of the apparatus in accordance with a preferred embodiment of the present invention.
Figure 2B:
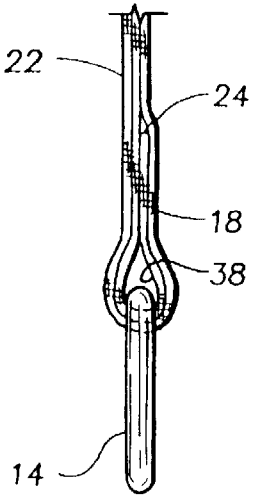
FIG. 2B is a schematic, side view of a second end portion of the apparatus in accordance with a preferred embodiment of the present invention.

Looking first to the method of manufacture of the preferred embodiment, FIGS. 2A and 2B respectively depict schematic, side views of first and second end portions 16, 18 of the apparatus 10. A first web end 24 is retained proximate large ring 14, while a remaining second web end 26 is alternately and successively passed through the large and small rings 14, 12 repeatedly until a desired number of web layers or plies are attained. In this particular embodiment, compliant element 20 is comprised of four ply layers in first and second end portions 16, 18 and solely three ply layers through the remaining central portion 22 thereof. Fewer or greater numbers of plies may be desired, depending, for example, on the load capability and the degree of compliance desired. Further, the overall linear extent of the additional ply sections in the end portions 16, 18 may be dictated to achieve a desired stiffness therein, relative to the more compliant central portion 22 to facilitate cantilevering of the end portion 18 during remote retrieval as will be discussed hereinbelow. Yet further, the first web end 24 is advantageously disposed within a central location of the nested ply layers to provide substantially smooth, uninterrupted external ply layer surfaces. Such a feature is desirable, since during remote installation and retrieval, the second end portion 18 is caused to travel over a tree limb. By disposing the first web end 24 centrally as depicted, snagging of the apparatus 10 on rough tree bark is generally prevented. Clearly, the position of rings 12, 14 may be interchanged and the exposed second web end 26 may be wrapped with cloth tape (not depicted) or other suitable material to blend the second web end 26 with the external ply layer surface thereby providing a substantially uninterrupted transition zone, if desired.

Figure 3:
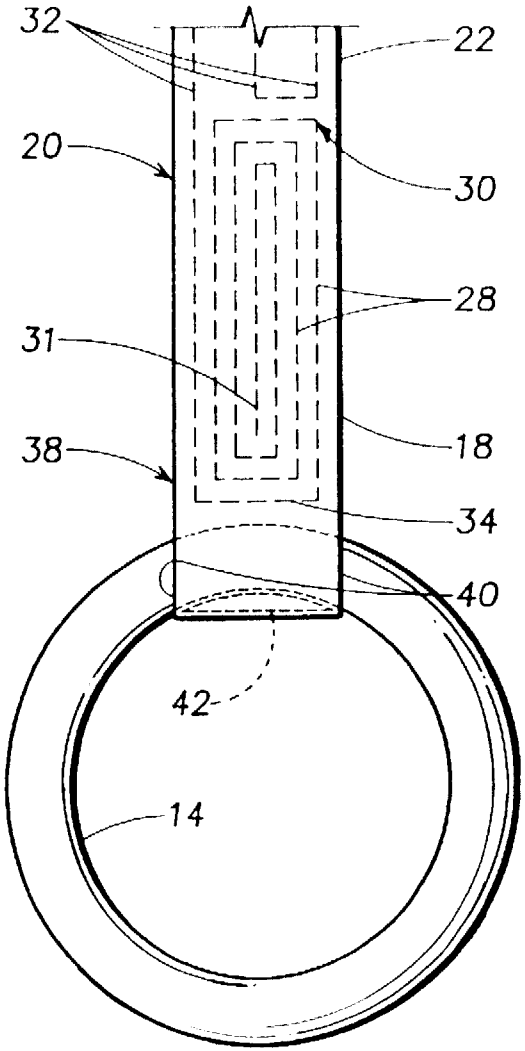
FIG. 3 in an enlarged schematic, plan view of the second end portion of the apparatus in accordance with a preferred embodiment of the present invention.

FIG. 3 depicts an enlarged schematic, plan view of the second end portion 18 of the apparatus 10 showing an exemplary method of manufacture. One or more series of stitching 28 is provided to resiliently attached one web ply layer to the next in order to maintain the geometric integrity of the compliant element 20. In the example shown, stitching 28 in the end portion 18 includes a continuous pattern of stitches which form a nested rectangular configuration 30, beginning at a centrally disposed first stitch 31, for example, and continuing in a substantially uninterrupted manner to thoroughly affix the web ply layers together in the end portion 18. First web end 24 is disposed within the nested configuration 30. Stitching continues along the length of the central portion 22 in three rows, shown generally at 32, disposed along central and edge regions of the central portion 22. A less dense stitching pattern may be employed here, the purpose being primarily to prevent separation or curling of the ply layers; whereas, along end portions 16, 18, a more dense stitching pattern is typically employed to reliably retain respective web ends 26, 24 and reduce compliancy. Stitching ultimately terminates in first end portion 16, in a substantially similar nested rectangular configuration 30. Clearly other patterns of stitching may be employed here and elsewhere, as desired, to achieve a functionally similar result.

In addition to providing integrity to the compliant element 20, transverse stitching 34 in both end portions 16, 18 create respective first and second loops 36, 38, as best seen in FIGS. 2A and 2B. As depicted, stitching 34 is advantageously positioned to provide loops 36, 38 of sufficient size to loosely is capture respective rings 12, 14, allowing for substantially free rotation of the rings 12, 14 in a circumferential direction. Such a configuration affords more uniform wear of the rings 12, 14 than if the rings 12, 14 were substantially immobilized relative to the webbing, for example by a girth hitch. Further, such a configuration, permits visual inspection of the inner web layers of the loops 36, 38 to check for wear. This capability is an important safety feature in load supporting devices such as apparatus 10, especially where the load being supported is generally an individual.

Referring once again to FIG. 3, since initial loading of the compliant element 20 occurs along edge portions 40 of the loops 36, 38 due to the geometric loading of a flat web loops by annular rings 12, 14, contoured inserts 42 may be provided therebetween. Each insert 42 may be utilized to more uniformly transmit the load from the rings 12, 14 across the width of respective loops 36, 38 by being advantageously configured to match the respective dimensional contours thereof. Such inserts 42 may be retained in the loops 36, 38 by any suitable method, such as stitching, bonding or clamping, and may further act as sacrificial wear surfaces to minimize distress to the rings 12, 14 and loops 36, 38. Inserts 42 may also flare outwardly beyond loop edge portions 40 and may partially or fully circumscribe the circumferential extent of the rings 12, 14 disposed within the loops 36, 38. In other words, inserts 42 may be configured to prevent direct contact between the rings 12, 14 and loops 36, 38 in any and all relative orientations, if desired. Inserts 42 may be manufactured from leather, polymer, metal or other suitable material.

Figure 4:
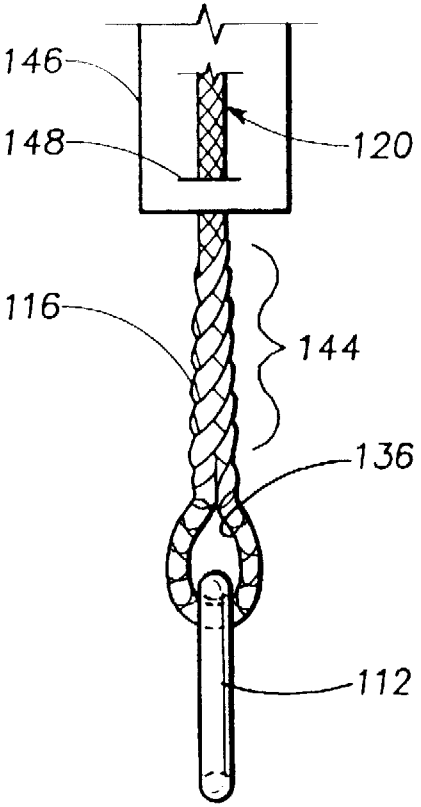
FIG. 4 is a schematic, side view of an end portion of the apparatus in accordance with an alternate embodiment of the present invention.

FIG. 4 is a schematic, side view of an apparatus compliant element end portion 116 in accordance with an alternate embodiment of the present invention. Instead of being formed of flat, stitched webbing, compliant element 120 is manufactured from natural, synthetic, wire or wire reinforced rope, which has been spliced into itself, as depicted generally at 144, or otherwise configured to form an eye or loop 136 at the end thereof to capture ring 112. Splice 144, routinely designated an eye splice, may be configured in any conventional manner and may include additional external wrapping or lashing to ensure the integrity and load carrying capability thereof. A suitably configured eyelet (not depicted) may be disposed within rope loop 136 to protect the loop 136 from abrasion or other damage. Further, especially in the application of wire rope, such a eyelet could also be employed to protect the ring 112 from gouging and nonuniform wear.

With any of the compliant element configurations disclosed, but especially in the case where any type of rope is used, compliant sheathing 146 may be employed to provide additional protection to the tree. Such sheathing 146 may, for example, be made of leather, rubber, polyester or other suitable material and may be of generally tubular construction through which the compliant element 120 passes. Alternately, sheathing 146 may be comprised of flat rectangular belting suitable for either continuous overlap wrapping around the compliant element 120 or being retained by threading compliant element 120 through slits 148 therein, as depicted in FIG. 4. Further, the sheathing 146 may extend along solely a portion of the compliant element 120 or may envelop substantially the entire compliant element 120. It is desirable that any sheathing 146 be readily removable or otherwise adjustable or retractable to afford visual inspection of the compliant element 120 for indications of distress.

Referring once again to FIG. 1, small ring 12 has an inner diameter value, $ID_S$, and an outer diameter value, $OD_S$, and large ring 14 similarly has an inner diameter value, $ID_L$, and an outer diameter value $OD_L$. While the rings 12, 14 may be configured with substantially any inner diameter values greater than an outer diameter value of a climbing support rope 50 passing therethrough, as well as any outer diameter values, by maintaining particular geometric relationships between the various diameters, an elegant solution to the problem of installation and retrieval of the apparatus may be realized. In particular, the apparatus may be reliably, repeatedly and safely installed in and retrieved from a suitable support location in a tree by an arborist located on the ground when $ID_S$ is less than $ID_L$ and $ID_L$ is less than $OD_S$. Additional details follow hereinbelow, with reference to FIGS. 6A, 6B and 6C. First, however, the support rope 50 may be advantageously modified to cooperate with the apparatus 10 to facilitate remote control thereof.

Figure 5A:
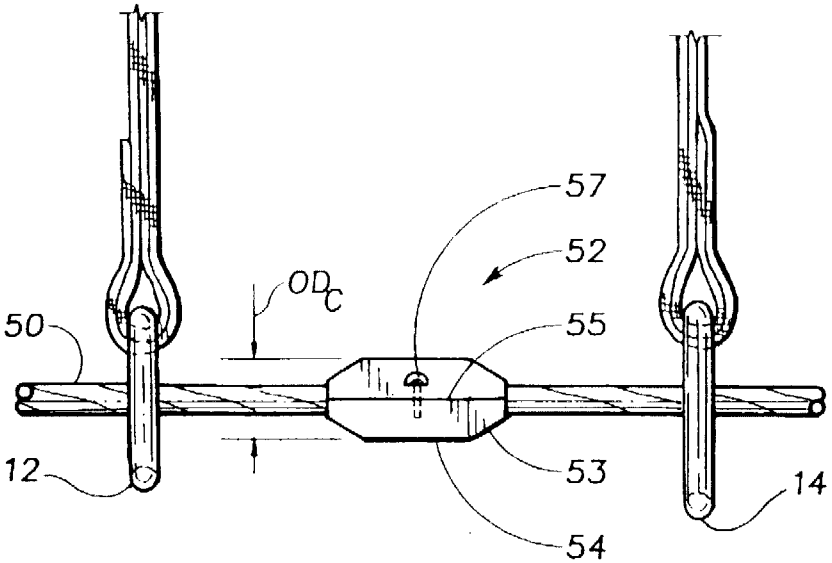
FIG. 5A is a schematic, partial plan view of a preferred embodiment of the present invention in combination with a first modified rope portion.
Figure 5B:
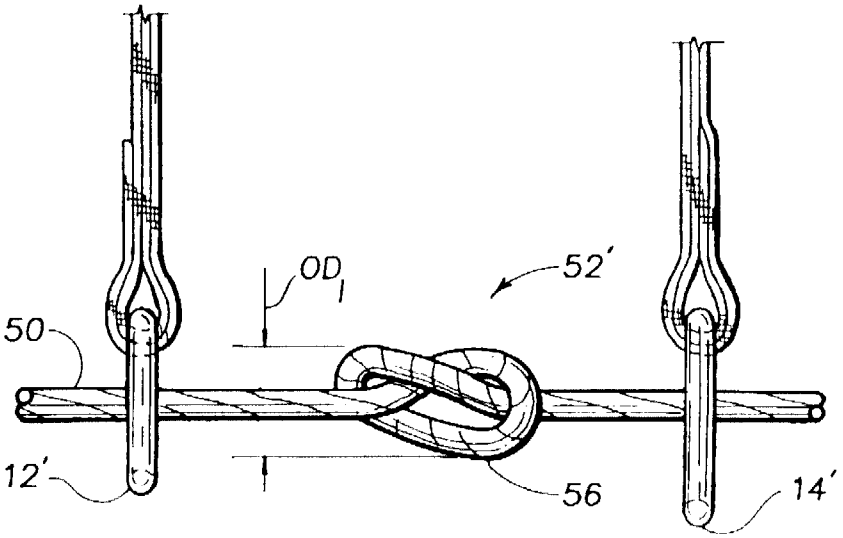
FIG. 5B is a schematic, partial plan view of a preferred embodiment of the present invention in combination with an alternate modified rope portion.

FIGS. 5A and 5B depict exemplary schematic embodiments of support ropes 50, 50', respectively, having alternate modified rope portions 52, 52' for this purpose. Looking first to FIG. SA, depicted is a length of support rope 50 passing serially through rings 12, 14. Rope 50 includes a modified portion 52, depicted here as a generally cylindrical collar 54 with tapered ends 53 affixed to rope 50 by any appropriate means. For example, the collar 54 may have an interference fit bore, a split line 55 and a threaded fastener 57 so that the collar 54 may be firmly clamped to the rope 50. Alternately, the collar 54 may have an integral cam and lever arrangement, may be bonded or otherwise disposed on the rope 50 in a predetermined location; however, it is generally preferable to affix the collar 54 by a separable method to permit removal or repositioning of the collar 54 on the rope 50 as desired. In the case of a collar 54 configured solely as an annular member, for example as a ring or washer, the collar 54 may be retained simply by capturing the collar 54 with knots or interlacements disposed in the rope 50 on either side thereof. Whatever the means for affixing the collar 54, the collar 54 preferably has a maximum outer diameter value, $OD_C$, which is both greater than $ID_S$, the inner diameter of the small ring 12, and less than $ID_L$, the inner diameter of the large ring 14. Accordingly, the collar 54 may readily pass through the large ring 14; however, the collar 54 is prevented from passing through small ring 12. The collar 54 may be manufactured from any suitable material, for example polymer, metal or rubber, and may be geometrically configured in any manner so as to permit passage solely through the large ring 14.

FIG. 5B depicts an alternate schematic view of climbing rope 50' in which the modified rope portion 52' comprises solely an interlacement 56 of the rope 50' itself. As with collar 54 depicted in FIG. 5A, the interlacement 56 may be of any geometric configuration and preferably has a maximum outer diameter value, $OD_I$, which is greater than $ID_S$, the inner diameter of the small ring 12', and less than $ID_L$, the inner diameter of the large ring 14'. While a fixed geometry collar 54 may be preferable in some applications where substantial tension must be applied to the climbing rope 50 during removal of the apparatus 10, for example if the apparatus 10 becomes caught on a tree branch, in practice, a simple interlacement 56, such as the overhand knot depicted in FIG. 5B, has been found to be sufficient in the majority of circumstances.

Figure 6C:
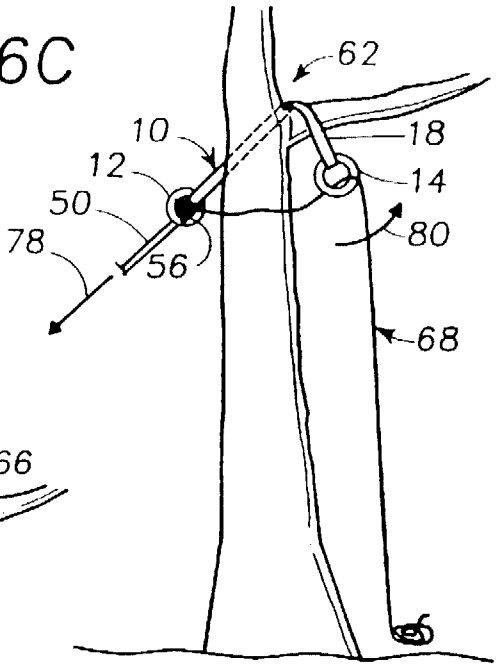
FIG. 6C is a schematic view of a step in an exemplary removal method for advantageous use of a preferred embodiment of the present invention.
Figure 6B:
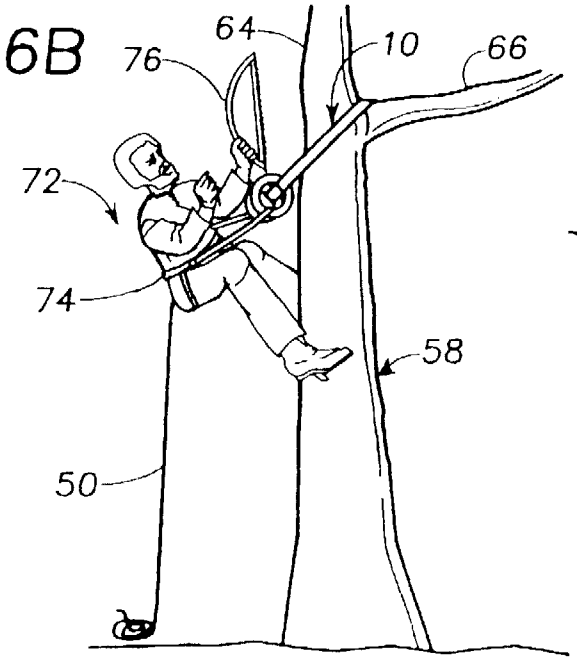
FIG. 6B is a schematic view of a preferred embodiment of the present invention in an exemplary installed state.
Figure 6A:
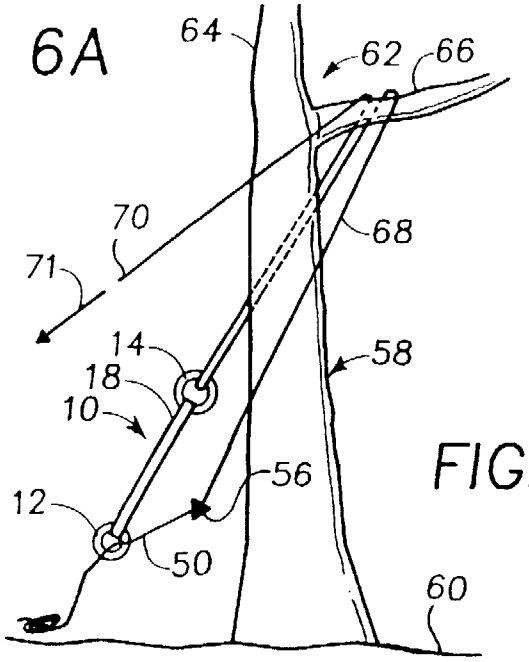
FIG. 6A is a schematic view of a step in an exemplary installation method for advantageous use of a preferred embodiment of the present invention.

FIGS. 6A, 6B and 6C are schematic representations of steps in respective installation, use and retrieval methods of the apparatus 10 in a typical application. Looking first to FIG. 6A, depicted is a lower portion of a typical tree 58 in which an arborist located on the ground 60 seeks to perform maintenance activities which require climbing the tree 58. After selecting a suitable support location, shown here generally as crotch 62 disposed at the junction of main stem 64 with limb 66, the arborist proceeds to install the apparatus 10. To facilitate installation, a strong, lightweight throw line 68, such as ⅛ inch nylon parachute cord, may be employed. Use of throw lines 68 generally to establish an initial threading path and provide for conveyance of heavier climbing ropes suitable for supporting an individual and equipment is well known to those skilled in the art. If desired, however, solely climbing rope 50 may be used.

In the exemplary installation method depicted, climbing rope 50 has already been passed through small ring 12 and the process of attaching the throw line 68 thereto has resulted in the formation of a suitable interlacement 56 in the rope 50 which prevents subsequent passage of the rope 50 back through the small ring 12. While the interlacement 56 is normally not required during the installation procedure, in the event the apparatus 10 becomes caught on an obstruction or contemplated installation is otherwise abandoned, the existence of a modified rope portion 52, whether it be an interlacement 56, collar 54 or other feature, is available to facilitate retrieval of the apparatus from the tree 58. Further, modified rope portion 52 does not substantially interfere with the installation method.

Once the throw line 68 has been attached to the rope 50, the throw line 68 is passed serially in front of the tree stem 64 and over the limb 66 in a first direction, generally into the plane of the figure as depicted in FIG. 6A. The throw line 68, which is now behind the tree stem 64 is next passed through the large ring 14 then back over the limb 66 in a direction opposite that of first travel. In other words, the throw line is passed over the limb 66 in a direction generally out of the plane of the figure as depicted in FIG. 6A. Upon application of tension to the free end 70 of throw line 68, generally along arrow 71, the apparatus 10 will be pulled into the desired support location in the crotch 62 with solely the large ring 14 and second end portion 18 being displaced over the limb 66. As the free end 70 is pulled further, interlacement 56 and rope 50 pass through the large ring 14 thereby completing the installation, the apparatus 10 being disposed in the desired support location in the tree crotch 62, with climbing rope 50 passing through both rings 12, 14.

FIG. 6B depicts the apparatus 10 in such an installed condition, being employed to support an arborist 72 donning a conventional climbing harness 74 to which climbing rope 50 is attached as discussed hereinabove. Throw line 68 may be removed, as depicted, or could simply be coiled and retained in the harness for subsequent use during remote retrieval of the apparatus 10. For purposes of illustration, a simple, low level ascent into the tree 58 has been depicted; however, as is readily apparent, the arborist 72 has considerable flexibility in choosing an appropriate support location for the apparatus 10 and may choose a series of increasing altitude locations to progressively reach higher work regions in the tree 58.

Once installed, apparatus 10 may be used by the arborist 72 solely to support rope 50 to facilitate climbing the tree 58 or additionally could be used alone to suspend, or with rope 50, to hoist arboreal tooling 76 such as the bow saw depicted, or other tooling such as pruners and heavy powered saws. Further, instead of locating the apparatus 10 in a crotch 62 as depicted in FIG. 6B, the apparatus could be located along a portion of limb 66 remote from main stem 64.

After completing requisite maintenance activity and descending from the work region or moving to another work region supported by an additional apparatus (not depicted), the first apparatus 10 may be safely removed from the support location in a controlled manner. Referring now to FIG. 6C, depicted is a ground level retrieval of the apparatus 10 with throw line 68 attached to rope 50 as discussed hereinabove, only a portion of the rope 50 proximate the interlacement 56 being shown for clarity. Tension is applied to the rope 50, generally along arrow 78, until the interlacement 56 passes through the large ring 14 and abuts small ring 12. Since the interlacement 56 is too large to pass through the inner diameter, $ID_S$, of the small ring 12, the apparatus 10 is displaced from the crotch 62 as shown. It is notable that due to the nonuniform compliancy of the apparatus 10, when the less compliant second end portion 18 contacts the crotch 62, additional displacement of the rope 50 causes the end portion 18 and large ring 14 to cantilever upwardly, as depicted in FIG. 6C, generally following arrow 80. In this manner, the apparatus 10 may be readily and reliably removed from the crotch 62. Once the end portion 18 and large ring 14 have cleared the crotch 62, descent of the apparatus 10 may be controlled with throw line 68, additional tension typically not needing to be applied to rope 50 due to the combined weight of the hanging rope 50 and apparatus 10. In the unlikely event the apparatus 10 becomes caught on an obstruction or snagged during the retrieval thereof, tension may be applied to either or both of the rope 50 and throw line 68 to displace and free the apparatus 10. It is desirable that end portion 18 be of sufficient stiffness through the combination of ply layers and stitching 28 to support the weight of the large ring 14 when disposed in a cantilevered orientation.

As may be appreciated by those skilled in the arboreal, rigging and climbing arts, apparatus 10 may be made of any of a variety of strong, preferably lightweight materials and in any size desired. In an exemplary embodiment useful in climbing residential trees with support limb or stem locations having a nominal diameter of up to about twelve inches, compliant element 20 may be manufactured from a single length of tubular nylon webbing having a flattened dimensional width of approximately one inch and a vertical dead load rated capacity of approximately 4000 pounds. Overall finished length of the compliant element 20 for this particular application from end of loop 36 to end of loop 38 is approximately sixty inches with the more compliant central portion 22 being three ply layers and about forty inches in length and the less compliant end portions 16, 18 being four ply layers and approximately eight inches in length each. Loops 36, 38 are each about two inches in length. The webbing is stitched together with nylon thread having nominal diameter, pitch and spacing in accordance with conventional practice in the manufacture of lifting slings for the loads contemplated, with a suitable safety factor.

Annular rings 12, 14 have nominal respective internal diameters of about 1.125 inches and 1.75 inches and nominal respective external diameters of about 2.0 inches and 2.625 inches, with circular cross-sectional diameters being substantially similar and equal to about 0.438 inches. Rings 12, 14 are smoothly contoured and manufactured from a high strength aluminum alloy. The apparatus 10 is configured for use with 0.5 inch nominal diameter synthetic climbing rope having a nominal dead load rating of 5400 pounds. Given the sizing of the rings 12, 14, the portion of rope 50 passing therethrough is supported by a rather generous, smooth combined radius which helps to lengthen rope life by preventing stress failure of the type exhibited by a rope under high loads subjected to a sharp, small radius or bight. Further, while friction is minimal, friction induced heat generated by travel of the rope 50 under load through the rings 12, 14 is advantageously rapidly dissipated due to the high coefficient of thermal conductivity of aluminum.

While there have been described herein what are considered to be preferred embodiments of the present invention, other modifications of the invention will become apparent to those skilled in the art from the teaching herein. For example, the webbing of compliant element 20 may be of lesser or greater dimensional width to modify the pressure or loading per unit area on the tree. Further, instead of being manufactured from tubular nylon webbing, other materials such as polyester, flexible metal wire mesh or Kevlar, and other configurations such as flat webbing may be utilized. The webbing may be uncoated or coated with protective materials such as urethane to increase cut resistance thereof. Yet further, the webbing may be integrally reinforced with additional high strength fibers woven therein or the compliant element 20 itself may be comprised of more than one type of material in single or multiple pieces. For example, to provide increased stiffness in the end portions 16, 18, pieces of sheet polymer of appropriate thickness may be stitched between web ply layers and the number and location of ply layers may be varied to control both load capability and compliancy as desired. Still further, the web plies need not be stitched together but could be attached one to the next by bonding, riveting, clamping or other suitable method, including the use of hook and loop fasteners. Additionally, the apparatus 10 may be made in any length desired and could include the capability to adjust the length thereof.

The rings 12, 14 also need not be made of aluminum, but rather could be manufactured from steel, titanium or virtually any metal alloy or superalloy. Alternately, the rings 12, 14 could be manufactured from non-metallic materials or compounds having sufficient durability and strength to meet operational requirements of the load bearing apparatus 10 with sufficient safety margin. Such non-metallic materials include polymers and resins reinforced with shaped fiberglass cores and as well as other composite structures impregnated with carbon fibers. In general, any materials which exhibit the requisite characteristics for the components described herein, such as compliancy, toughness, durability and strength, which in combination are suitable for use and substantially function in the manner disclosed herein are considered within the scope of the disclosed invention.

Regarding rope 50 and the modified portion 52 thereof, collar 54 may be nominally sized to pass through the inner diameter of small ring 12 if collar 54 is provided with spring loaded tabs or other retractable tapered elements extending outwardly therefrom such that the collar 54 may readily pass through the ring 12 in a first direction. Manual depression or retraction of the tabs would be required to permit passage through the ring 12 in the opposite direction. Alternately, an end portion of rope 50 may be configured with an interlacement 56 in the form of an eye splice of sufficient dimension to prevent passage through the small ring. Such a feature not only affords the advantages disclosed hereinabove with regard to remote retrieval of the apparatus 10 but would also facilitate attachment of the rope 50 to the throw line 68, climbing harness 74 or arboreal tooling 76 either directly or in conjunction with conventional climbing and industrial hardware such as a spring-loaded carabiner or a chain connector, having an opening traversed by a retractable, threaded nut member. Such chain connectors are often referred to as quick links.

Lastly, use of the apparatus 10 and methods of remote installation and retrieval thereof are clearly not limited to practice by arborists in the maintenance of trees. The invention has broad applicability to any situation in which a load is desired to be supported temporarily or permanently from a support structure in a safe, reliable manner including, but not limited to, applications in search and rescue, rock and mountain climbing, spelunking, hiking, hunting and wilderness exploration. The combination of high strength, light weight and remote installation and retrieval afford the user of the apparatus 10 heretofore unknown functionality and flexibility in a climbing and support device.

It is therefore desired to be secured in the appended claims all such modifications as fall within the true spirit and scope of the invention. Accordingly, what is desired to be secured by Letters Patent of the United States is the invention as defined and differentiated in the following claims.

I claim:

1. An arboreal climbing and support apparatus comprising:

a compliant element;

a first closed annular member loosely captured by said compliant element at a proximal end thereof; and a second closed annular member loosely captured by said compliant element at a distal end thereof, wherein said first and second annular members are configured to preclude passage of either one of said annular members through another, and said first and second annular members have dissimilar respective internal diameter values.

2. The invention according to claim 1 wherein:

said compliant element is nonuniformly compliant.

3. The invention according to claim 2 wherein:

said compliant element is more compliant along a centrally disposed portion thereof than along respective portions of at least one of said proximal and distal ends.

4. The invention according to claim 3 wherein:

at least one of said respective portions of at least one of said proximal and distal ends is able to substantially support weight of said respective portion and said respective annular member captured thereby when disposed in a cantilevered orientation.

5. The invention according to claim 1 wherein:

said compliant element comprises a substantially continuous length of webbing looped alternately and successively through said first and second annular members, successive plies of said webbing being layered and attached one to another to capture said annular members within respective loops formed at said proximal and distal ends thereof.

6. The invention according to claim 5 wherein:

said successive plies are attached one to another by stitches passing therethrough.

7. The invention according to claim 5 wherein:

at least one of said proximal and distal ends comprises at least one additional ply layer than a centrally disposed portion of said compliant element.

8. The invention according to claim 5 wherein:

at least one of said first and second annular members is substantially free to rotate circumferentially within said respective proximal or distal end loops.

9. The invention according to claim 5 further comprising:

an insert disposed in at least one of said loops between said webbing and said respective annular member.

10. The invention according to claim 1 wherein:

said first annular member has an internal diameter value less than an internal diameter value of said second annular member.

11. The invention according to claim 10 wherein:

said internal diameter value of said second annular member is less than an external diameter value of said first annular member.

12. The invention according to claim 1 wherein:

at least one of said first and second annular members are comprised, at least in part, of aluminum.

13. A method for remotely installing an arboreal climbing and support apparatus over a support member comprising the steps of:

providing a climbing and support apparatus comprising:

a compliant element;

a first closed annular member captured by said compliant element at a proximal end thereof; and a second closed annular member captured by said compliant element at a distal end thereof, wherein said first and second annular members have dissimilar respective internal diameter values;

providing a rope having a free end;

serially passing said rope free end:

(a) through said first annular member;

(b) over a support member in a first direction;

(c) through said second annular member; and (d) over said support member in an opposite direction relative to said first direction; and applying tension to said rope free end to displace said second annular member over said support member along said first direction.

14. The method according to claim 13 further comprising the step of:

employing said rope to support, at least in part, a load from said support member.

15. The method according to claim 14 wherein:

the step of supporting a load with said rope comprises the step of:

attaching said rope to a harness at at least one point, said harness being suitable for donning by an individual.

16. The method according to claim 14 wherein:

the step of supporting a load with said rope comprises the step of:

attaching said rope to at least one arboreal tooling apparatus.

17. The method according to claim 13, further comprising the step of:

providing means for preventing passage of a portion of said rope through said first annular member along at least one direction while permitting passage of said rope portion through said second annular member.

18. The method according to claim 17 wherein:

said passage prevention means comprises an interlacement formed in said rope portion.

19. The method according to claim 18 wherein:

said interlacement comprises an eye splice.

20. The method according to claim 17 wherein:

said passage prevention means comprises a collar disposed on said rope portion.

21. The method according to claim 13 further comprising the steps of:

reducing relative tension applied to said rope free end; and permitting said second annular member to be displaced from over said support member.

22. The method according to claim 13 wherein:

said rope comprises a throw line in combination with a climbing rope.

* * * * *